United States Patent [19]

Beyer

[11] Patent Number: 4,528,734

[45] Date of Patent: Jul. 16, 1985

[54] METHOD OF SPIN FORGING A VEHICLE WHEEL

[75] Inventor: Michael J. Beyer, Huntington Beach, Calif.

[73] Assignee: NI Industries, Inc., Novi, Mich.

[21] Appl. No.: 396,306

[22] Filed: Jul. 8, 1982

[51] Int. Cl.[3] ..... B21H 1/02

[52] U.S. Cl. ..... 29/159.01; 29/159 R; 72/68

[58] Field of Search ..... 29/159 R, 159.1, 159.01; 72/68, 83, 85; 148/11.5 A

[56] References Cited

U.S. PATENT DOCUMENTS

| | | | |
|---|---|---|---|
| 1,795,379 | 3/1931 | Schmidt | 72/84 |
| 2,075,294 | 3/1937 | Le Jeune | 29/159.01 |
| 2,084,814 | 6/1937 | Le Jeune | 72/365 |
| 2,825,961 | 3/1958 | Woodward | 29/159.1 |
| 3,205,688 | 9/1965 | Paulton | 29/159.01 |
| 3,672,021 | 6/1972 | Schulte et al. | 29/159.01 |
| 3,822,458 | 7/1974 | Schulte et al. | 29/159.01 |
| 3,823,591 | 7/1974 | Schröder et al. | 29/159 R |
| 4,000,634 | 1/1977 | Hixson | 29/159 R |
| 4,048,828 | 9/1977 | Lucas et al. | 29/159.01 |
| 4,064,724 | 12/1977 | Armstrong | 29/159 R |
| 4,170,888 | 10/1979 | Golata | 72/82 |

FOREIGN PATENT DOCUMENTS

| | | | |
|---|---|---|---|
| 709573 | 8/1941 | Fed. Rep. of Germany . | |
| 200892 | 5/1958 | Fed. Rep. of Germany . | |
| 1068654 | 7/1959 | Fed. Rep. of Germany . | |
| 1297570 | 2/1970 | Fed. Rep. of Germany . | |
| 1752895 | 7/1971 | Fed. Rep. of Germany . | |
| 2732651 | 1/1979 | Fed. Rep. of Germany . | |
| 1339227 | 5/1963 | France . | |
| 1365089 | 5/1964 | France . | |
| 575341 | 1/1957 | Italy . | |
| 351570 | 3/1961 | Switzerland . | |
| 891678 | 3/1962 | United Kingdom | 148/11.5 A |

*Primary Examiner*—Howard N. Goldberg
*Assistant Examiner*—P. W. Echols
*Attorney, Agent, or Firm*—Harness, Dickey & Pierce

[57] ABSTRACT

A method of forming a one piece vehicle wheel is disclosed which method includes the steps of initially forging a rough vehicle wheel shape which is then subjected to a series of spinning operations to contour the rim portion thereof. Part of the final contouring of the rim portion of the wheel is performed without mandrel backing and the entire final contouring is performed after a solution heat treatment thereof in order to assure accurate formation thereof. Additionally, if desired, final machining and/or trimming operations may be performed without removing the wheel from the final contouring apparatus.

18 Claims, 10 Drawing Figures

METHOD OF SPIN FORGING A VEHICLE WHEEL

The present invention relates generally to the formation of vehicle wheels and more particularly to an improved method of forming a one piece vehicle wheel by a spin forging process.

Numerous attempts have been made to provide a method to form a one piece vehicle wheel from a lightweight alloy which is both economical and efficient. Such one piece wheels offer many advantages over conventional welded steel wheels or the like particularly with regard to the present day efforts toward improved fuel efficiency. Not only do these wheels facilitate the use of lighter weight alloys such as aluminum but they also facilitate the structuring of the wheel itself to minimize cross sectional material area in areas of low stress and increase same in the higher areas of stress thereby providing a strong wheel while minimizing the overall weight thereof.

The method of the present invention begins with a cast log from which a billet is severed which is then subjected to a series of hot forging operations to form the wheel center and a pair of rim flange legs. Thereafter, the forging is subjected to a trimming operation. The forged and trimmed wheel blank is then rough formed by means of a pair of spinning rollers which operate to axially elongate one of the rim flange legs and to selectively vary the cross sectional thickness thereof. This rough formed wheel is then subjected to a first solution heat treatment after which final contouring and shaping is performed by additional spinning rollers. A portion of this final contouring is performed without a backing mandrel or chuck which substantially reduces the attendant tooling complexity and costs as well as facilitating mounting on and removal of the finally formed wheel from the chuck. Additionally, suitable cutters may be associated with the final spinning apparatus to face the mounting surface portion of the wheel center prior to removal of the wheel from the final spinning apparatus. Performing this machining operation on the same apparatus as the final spinning assures concentricity of the rim and wheel center. Upon final contouring of the wheel, final machining of valve and bolt holes may be done followed by suitable appearance finishing and heat treating to thereby provide a finished one piece vehicle wheel.

Additional advantages and features of the present invention will become apparent from the subsequent description and the appended claims taken in conjunction with the accompanying drawings.

DESCRIPTION OF THE PREFERRED EMBODIMENT

Figure 4:
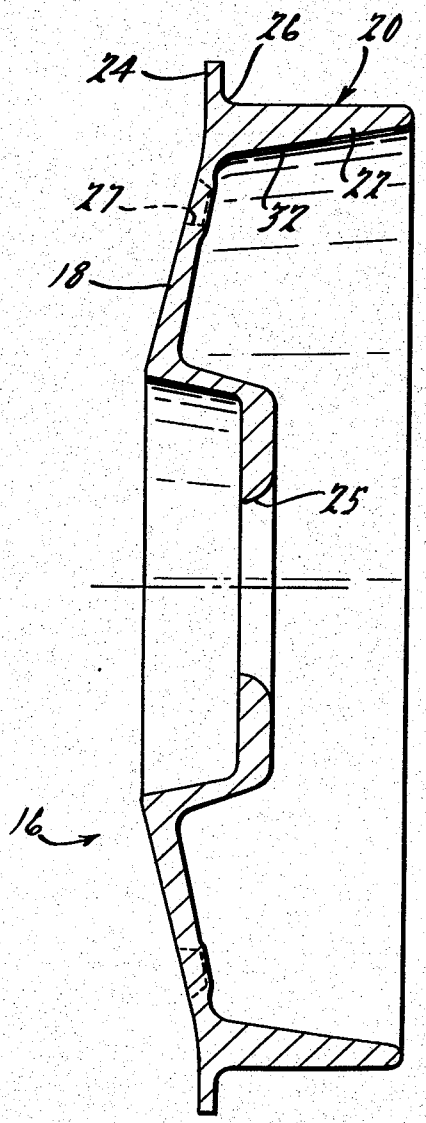
FIGS. 1 through 4 are sectioned views showing successively the initial steps of forming a one piece vehicle wheel in accordance with the present invention begining with the severing of a billet from a cast log through a series of sequential hot forging operations, the sections being taken along a radial plane extending along the axis of rotation of the wheel.
Figure 3:
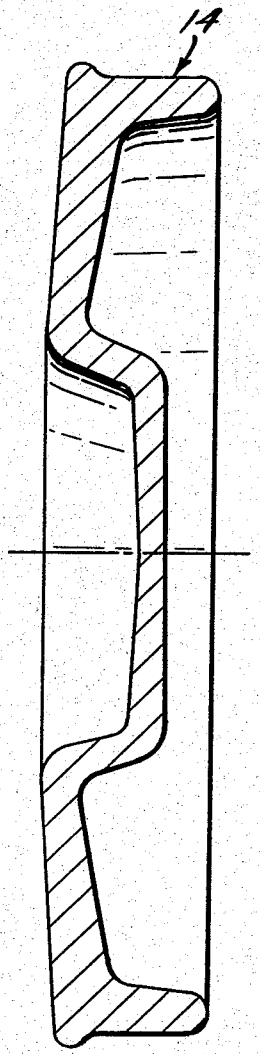
Figure 2:
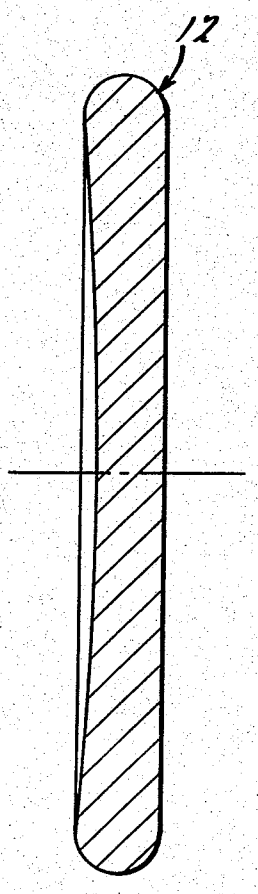
Figure 1:
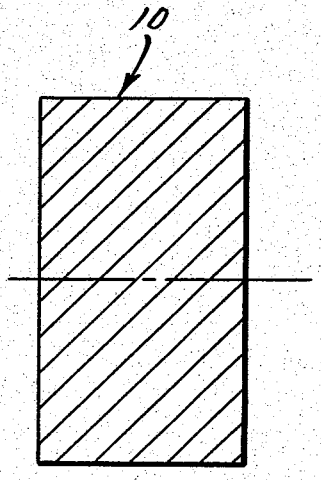

Referring now to the drawings and in particular to FIGS. 1 through 4, the initial forming steps of the present invention are shown and comprise severing a suitably sized generally cylindrical billet 10 from a cast log of a suitable forgeable and spinnable material such as for example an aluminum or other suitable alloy. The thus severed billet 10 is then heated to a suitable temperature to render it suitable for a series of hot forging operations such as for example approximately 850° to 900° F. for an aluminum alloy billet. The billet 10 is then progressively moved through a series of forging operations and transformed thereby first to an enlarged diameter biscuit 12 as shown in FIG. 2 to a partially formed blank 14 and ultimately to a fully forged wheel blank 16 of the general shape shown in FIG. 4 which includes in cross section a wheel center 18 and a rim portion 20 having a relatively long axial leg 22 and a relatively short radial leg 24 with wheel center 18 joining the rim portion 20 in the vicinity of the juncture 26 of axial and radial legs 22 and 24.

Once the forging of the billet has been completed, the outside diameter of the radially extending leg may be trimmed and any flashing surrounding the central opening 25 in the wheel center 18 of the forged wheel blank 16 removed. Additionally it should be noted that should it be desired, any openings 27 or the like may also be partially or even fully formed on the wheel center. The number, size and arrangement of any such openings 27, as well as the desirability of forming same at this stage, will depend on the design and/or the need for anchors for subsequent operations. It should be noted that preferably the forming of these openings will be deferred to avoid the possibility that subsequent forming of the forging may result in collapsing or other deformation thereof.

Figure 5A:
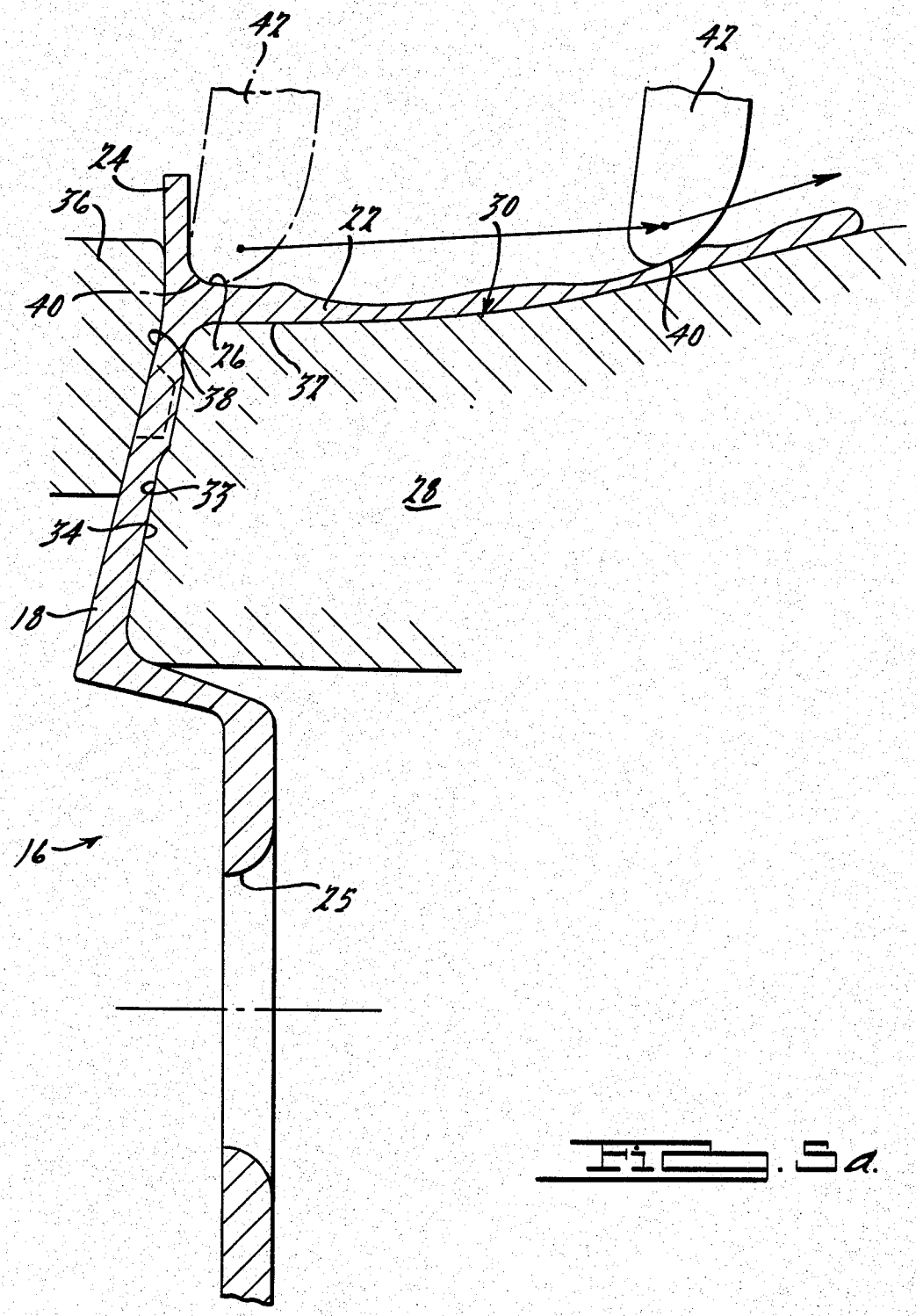
FIGS. 5*a* and 5*b* are fragmentary sectioned views of the forging shown in FIG. 4 and illustrating an initial rough forming thereof by first and second spinning rollers respectively, the sections being taken along a radial plane extending along the axis of rotation of the vehicle wheel.
Figure 5B:
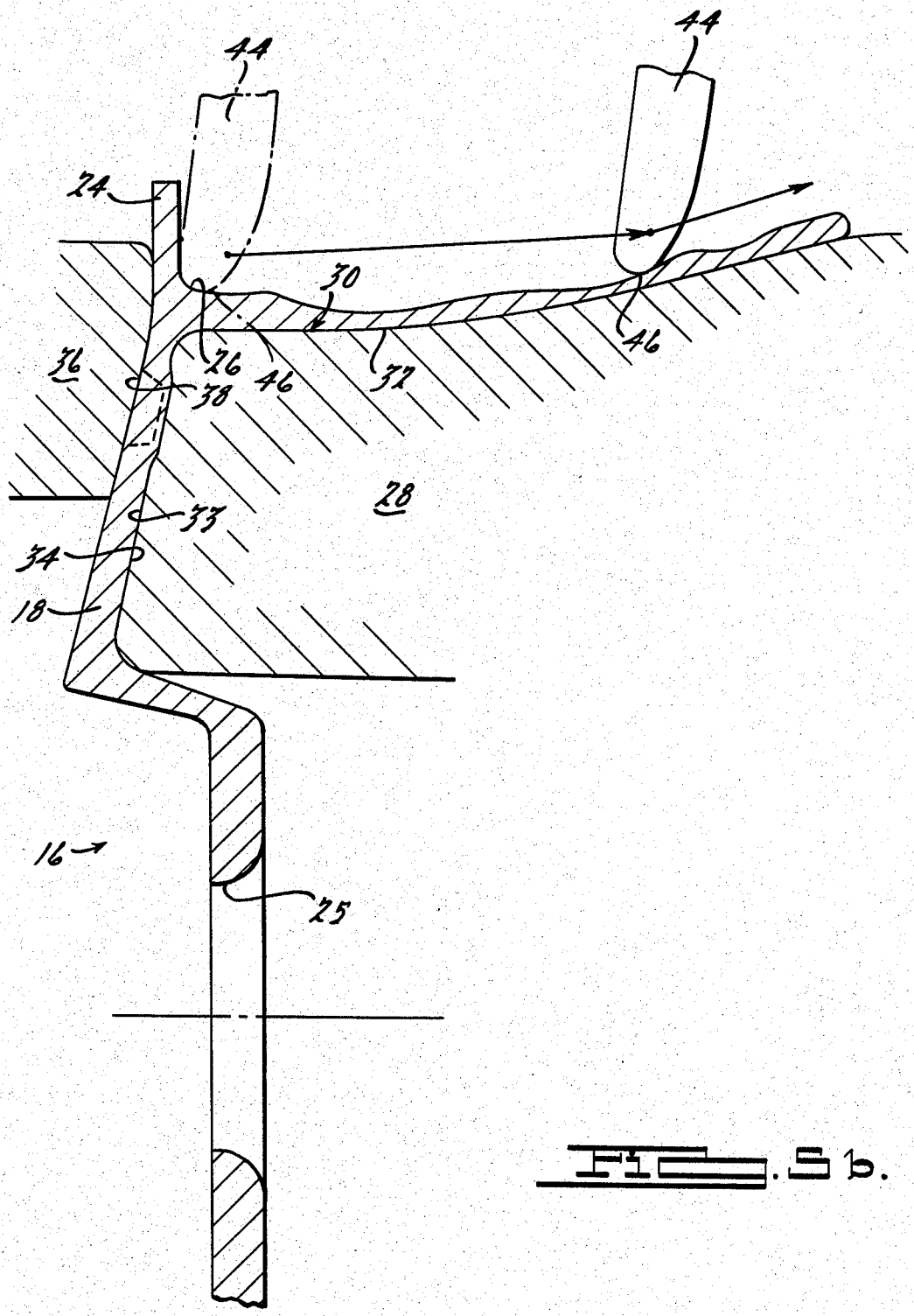

In any event, the thus completely forged wheel blank 16 is then mounted on a chuck 28 having an externally contoured surface 30 generally as shown in FIGS. 5(*a*) and 5(*b*) which is positioned in adjacent radial alignment with the radially inner surface 32 of axially extending leg 22. This contoured surface 30 has an axial dimension substantially greater than that of axial leg 22. Chuck 28 also has a leading surface 33 contoured to engage the axially inner surface 34 of wheel center 18. A tail stock 36 is provided which engages the opposite surface 38 of the wheel center 18 so as to clamp the wheel forging 16 against surface 32 of chuck 28. The thus clamped wheel forging 16 and associated tail stock 36 and chuck 28 are then rotated about the axis of wheel forging 16 while the rounded peripheral edge 40 of metal spinning roller 42 is advanced into engagement with wheel forging 16 at approximately juncture 26 between the axial and radially extending legs 22 and 24. Metal spinning roller 42 is forced generally radially inwardly at juncture 26 and thence moved generally axially away from the radially outwardly extending leg 24 so as to deform and reduce the thickness of and to lengthen or extend axial leg 22 along contoured surface 30.

As shown in FIG. 5(*b*), a second metal spinning roller 44 also having a rounded peripheral edge 46 is advanced and forced into engagement with forged wheel 16 at approximately juncture 26 simultaneously or subsequent to engagement of roller 40 therewith. Roller 44 is then also advanced generally axially along leg 22 and away from radial leg 24 during which it is also simultaneously moved in a generally radial direction so as to roughly contour axial leg 22 thereby varying the radial thickness thereof. Preferably rollers 42 and 44 will be positioned on diametrically opposite sides of wheel 16 and will operate substantially simultaneously to move axially along axial leg 22 with roller 44 trailing slightly behind roller 42. As shown the peripheral edge 40 of metal spinning roller 42 has a substantially greater radius of curvature than the peripheral edge 46 of metal spinning roller 44. While the generally opposite positioning and simultaneous movement of rollers 42 and 44 offers the advantage of reduced processing time, should it be desirable these two forming steps may also be performed sequentially on the same or different spinning apparatus.

Once the wheel has been rough formed by forming rollers 42 and 44 it is then subjected to a solution heat treatment to impart a T4 material condition thereto. For a 6061 aluminum alloy, this heat treatment may comprise raising the temperature of the rough formed wheel structure to approximately 980° F. after which it may be liquid quenched.

Figure 6A:
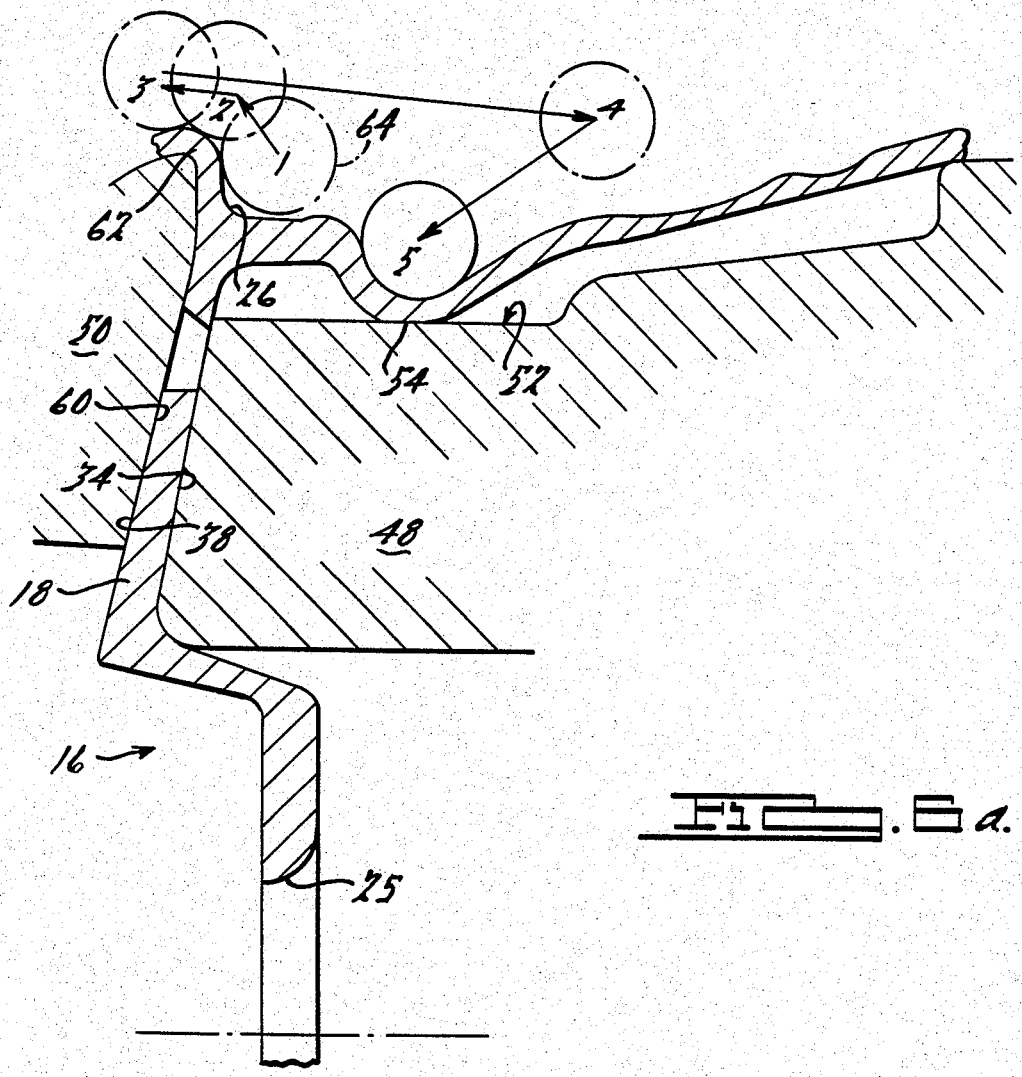
FIGS. 6*a* and 6*b* are fragmentary sectioned views of the rough formed wheel similar to those of FIGS. 5*a* and 5*b* but showing subsequent contouring thereof by additional spinning rollers.

Next the forged rough formed and heat treated wheel 16 is mounted and clamped between a second chuck 48 and tail stock 50. Chuck 48 also has an external contoured surface 52 generally as shown and which conforms substantially to the final shape of the inside surface of the finished rim portion of the wheel from the minimum inside diameter portion 54 of the drop center to the axially outer surface 56 of the tire bead retaining flange 58 disposed furthest from the wheel center 18. Contoured surface 52 also extends generally axially from the minimum inside diameter portion of the drop center 54 to and engages the inside axial surface 34 of the wheel center 18. Tail stock will also have a contoured surface 60 conforming to the radially outside surface 38 of the wheel center 18 and the outside surface of the tire bead retaining flange 62 most adjacent thereto. Once clamped, forged rough formed wheel 16 and associated tail stock 50 and chuck 48 will then be rotated and another metal spinning roller 64 also having a rounded peripheral edge will be advanced and forced into engagement with wheel 16 approximately at or adjacent juncture 26 and thence moved in a generally radially outwardly direction and thence axially toward tail stock 50 so as to deform tire bead retaining flange 62 thereover. This sequence of movement is shown in FIG. 6*a* as including movement of roller 64 into position 1 and thence through positions 2 and 3. Roller 64 will then be moved out of engagement with the rotating wheel 16 and in a generally axially direction into position 4 as indicated in FIG. 6*a* whereupon it will once again be advanced and forced into engagement with axial leg 22 at a position axially spaced from the wheel center 18 so as to cause a generally radially inward deformation of a portion of axial leg 22 into engagement with contoured surface 52 of chuck 48 thereby forming a first portion of the drop center 54. Thereafter metal spinning roller 64 will be moved in a generally axial direction away from the wheel center 18 so as to cause the generally axially extending leg 22 of the forged rough formed wheel 16 to roughly conform to surface contour 52 of the chuck 48. This process is shown in FIG. 6(*b*) by the successive advancement of the metal spinning roller from the position indicated by reference number 5 through positions 6, 7, 8, and finally into position 9 wherein the bead retaining flange 58 is deformed.

It should be noted that while metal spinning roller 64 has been described and shown as initially moving through successive steps 1 through 3, and then from position 4 through 9, should it be desired, the movement of this roller from position 4 through 9 may be carried out prior to the sequence of movement from positions 1 through 3. It should also be noted that both the force and angle or direction of movement of roller 64 from position 4 to 5 wherein the axial leg is being radially deformed to initially form the drop center portion of the wheel 16 must be carefully controlled relative to the material being formed so as to prevent collapse or other deformation of the portion of axial leg 22 extending to bead retaining flange 62 which is not supported by chuck 48.

Figure 7:
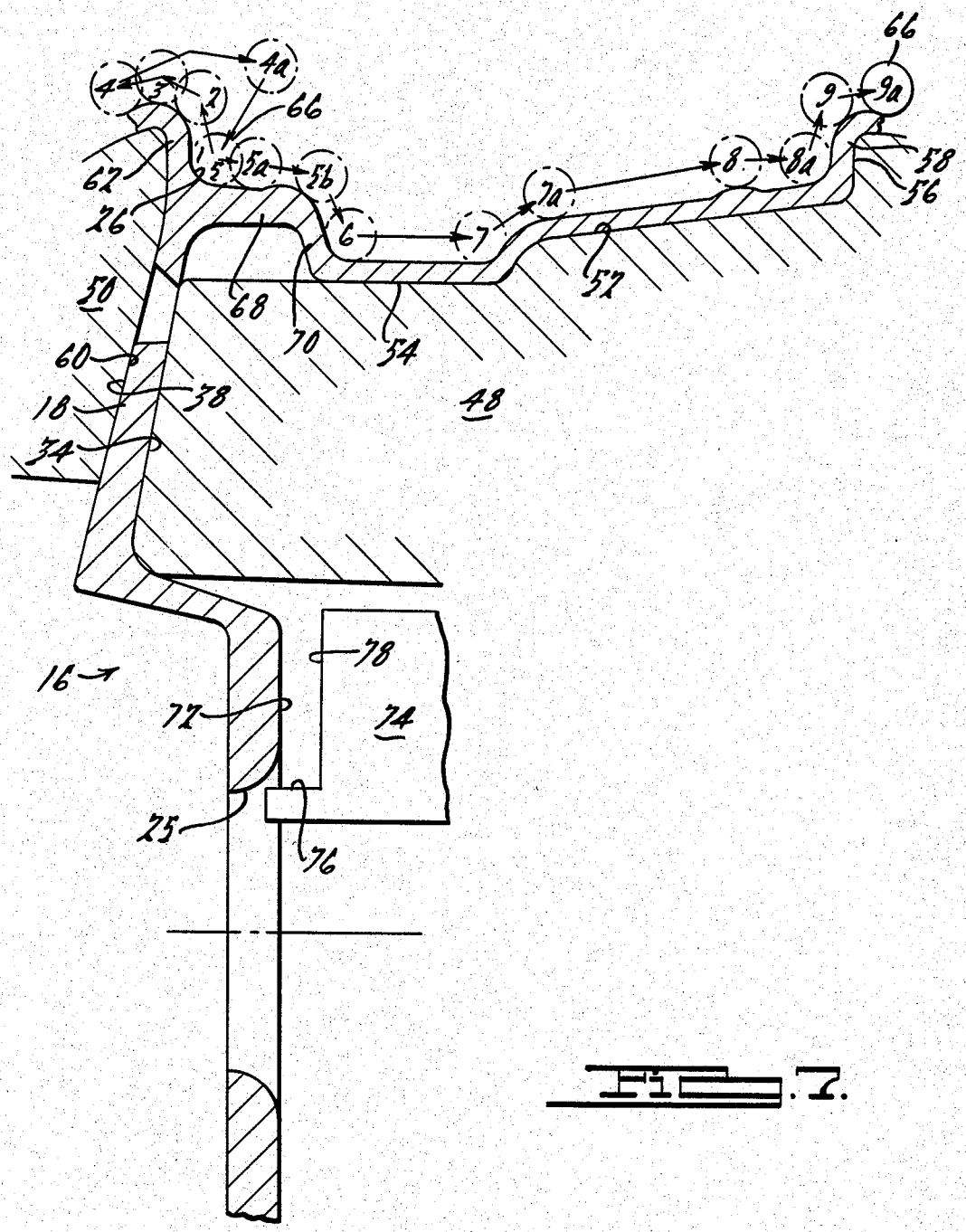
FIG. 7 is a fragmentary sectioned view of the wheel similar to that of FIGS. 6*a* and *b* showing the sequential movement of the final spinning roller.
Figure 8:
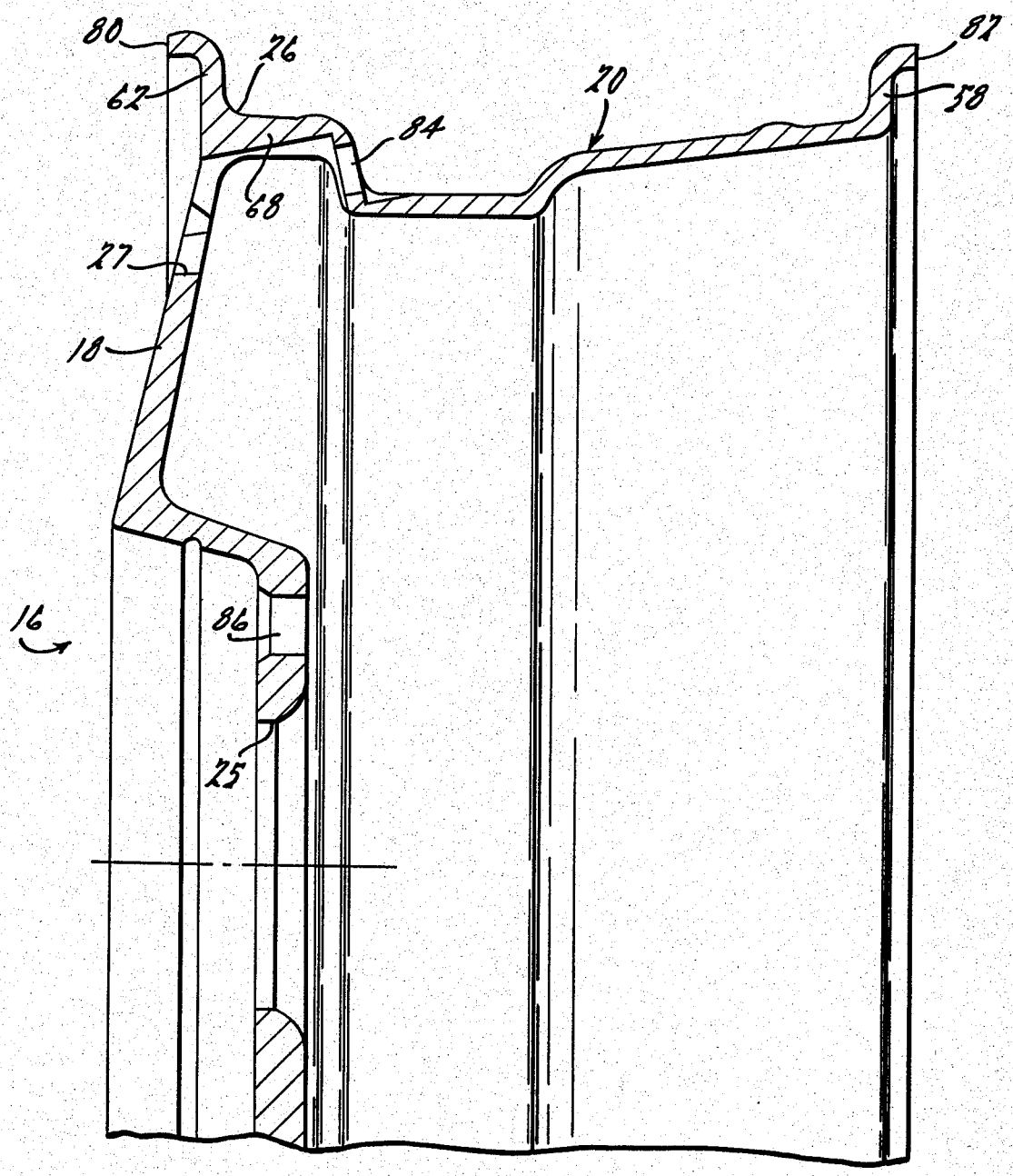
FIG. 8 is a fragmentary sectioned view of the one piece vehicle wheel fully formed in accordance with the present method, the section also being taken along a radial plane extending along the axis of rotation.

Another metal spinning roller 66 is also preferably moved into engagement with the rough formed wheel structure while it is being rotated between the contoured chuck 48 and tail stock 50 and as shown in FIG. 7, this second metal spinning roller 66 will be initially moved into engagement with juncture 26 of the axial and radially extending legs 22 and 24 and thence moved in a general radially outward direction and thereafter in an axial direction away from the axially extending leg so as to finish form bead retaining flange 62. This is represented by the successive movement of the metal spinning roller from position 1 through position 4 in FIG. 7. Thereafter metal spinning roller 66 is moved out of engagement with rotating wheel 16 and then in a generally axial direction into position 4*a* whereupon it is moved in a generally radial direction back into engagement with juncture 26 between axial and radially extending legs 22 and 24. Thereafter, metal spinning roller 66 is moved in a generally axial direction so as to finally form axial flange portion 68 which defines a bead seat. This movement is shown by the advancement of roller 66 from position 5 in FIG. 7 through position 6. Thereafter, metal spinning roller 66 is moved in a generally radial inward direction so as to finally form a first wall portion 70 of the drop center section and thence in a general axial direction so as to finally form the drop center portion against contoured surface 52 of chuck 48. Continued generally axial and radially outward movement of metal spinning roller 66 will cause final deformation of the generally axially extending leg 22 into substantial conformance with the contour provided on the contoured surface 52 of chuck 48 which, as previously mentioned, conforms to the final desired inner contour of the vehicle wheel.

Figure 6B:
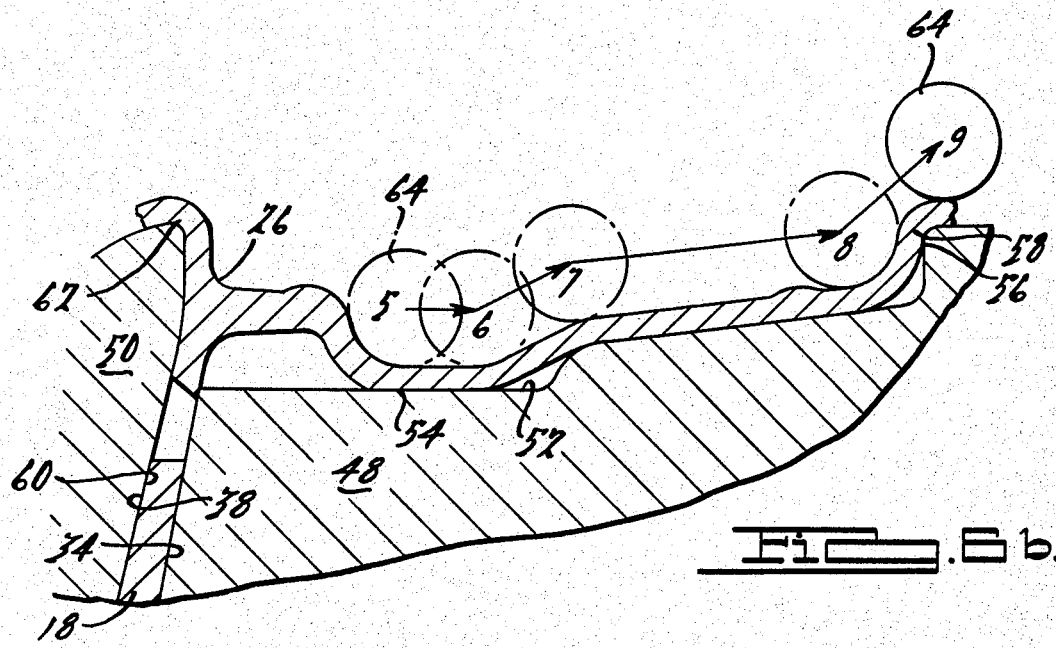

While the first final forming steps shown and described with reference to FIGS. 6*a* and 6*b* and second final forming steps shown in FIG. 7 may be performed separately in sequence on the same or different apparatus, it is preferred that they be performed simultaneously with rollers 64 and 66 positioned on diametric opposite sides of wheel 16 in order to reduce the overall time required for manufacturing of the wheel 16. In this respect the position sequence reference numbers of roller 64 and roller 66 correspond. That is, when roller 64 is in position 1, roller 66 will also be in position 1, as roller 64 moves to position 2, roller 66 will also move to position 2. It is noted that roller 64 performs the major forming and hence will be advanced slightly ahead of roller 66 which finishes the forming operation. Also, it is noted that the peripheral edge of roller 64 is provided with a substantially greater radius of curvature than the peripheral edge of roller 66.

It is noted that the final forming of bead seat 68 is performed without support from chuck 48. Thus, in order to avoid deflection of this seat 68 during the final forming pass of roller 66, roller 64 is advanced from position 4 to position 5 (as shown in FIG. 6(*a*)) and remains there while roller 66 is moved from position 4*a* to position 5 and thence through position 5(*a*) and to position 5(*b*).

While the above forming sequence has indicated that rollers 64 and 66 are moved sequentially from position 1 through 9, if desired, the forming steps represented by movement of rollers 64 and 66 from position 4 through 9 may be performed prior to the steps represented by movement of rollers 64 and 66 from position 1 through position 3.

Once rim portion 20 of wheel 16 has thus been final formed to the desired shape and preferably before it is removed from chuck 48, it is desirable to face mounting surface 72 of wheel center 18 and to machine center opening 25 to its finished size. Accordingly, a plurality of circumferentially spaced cutters 74 are provided and axially reciprocable with respect to wheel 16. As shown in FIG. 7, each of the cutters 74 will be substantially identical and will include a first cutting surface 76 operative to initially engage and machine the periphery of opening 25 to size as wheel 16 continues to rotate. A second cutting surface 78 is provided which will move into engagement and face mounting surface 72 of wheel center 18.

Performing this cutting operation while wheel 16 is still clamped on the final forming apparatus offers several advantages in that it insures that the center opening 25 and mounting surface 72 will be precisely concentric and true with respect to the tire supporting bead seats.

Thereafter the finally contoured wheel 16 may be removed from between the chuck 48 and tail stock 50 and final machining operations performed thereon such as to finally trim ends 80 and 82 of the bead retaining rim flanges, drill and counterbore the valve hole 84 and drill and chamfer bolt holes 86 as necessary. Upon completion of these maching operations the completed wheel may then be finished in any desired manner such as with a clear coat and/or painting. Additionally, it is also necesary to subject the finished wheel to a precipitation heat treatment in order to increase the hardness thereof and achieve a T6 material condition. For example, when a 6061 aluminum alloy is used this may be achieved by subjecting the finished wheel to a temperature of around 350° F. for a period of about eight hours. It should be noted, however, that this precipitation heat treat procedure may be varied slightly because the spinning operations heretofore described have been carried out with a material condition of T4.

While it will be apparent that the preferred embodiment of the invention disclosed is well calculated to provide the advantages and features above stated, it will be appreciated that the invention is susceptible to modification, variation and change without departing from the proper scope or fair meaning of the subjoined claims.

I claim:

1. A method of forming a vehicle wheel out of a spin forging formable material, wherein said wheel includes a rim having in cross-section a drop center, generally axial integral flanges extending in opposite directions therefrom, a generally radial tire-bead retaining flange extending from the outside of each of said axial flanges, and a wheel center joining said rim adjacent the axially outer portion of said rim, said method comprising the steps of:

(a) forging a billet of said material into the rough shape of the finished wheel, including said wheel center and a rim portion having in cross-section a relatively long axial leg and a relatively short radial leg, said wheel center joining said rim portion in the vicinity of the juncture of said legs;

(b) mounting said forged billet over a chuck having an external contoured surface conforming to the final inside shape of the wheel from the minimum inside diameter portion of said drop center to the axially outer surface of the tire-bead flange disposed furthest from said wheel center, said contoured surface extending generally axially in the opposite direction from the minimum diameter portion of said drop center to the inside axial surface of said wheel center;

(c) securing said forging on said chuck;

(d) rotating said chuck and forging about the center axis of said wheel;

(e) thereafter forcing the outer periphey of a roller against said axial leg of said rim in a direction generally radially inwardly and axially toward said wheel center to roughly form the side of said drop center nearest said wheel center, the force and direction being controlled to prevent collapsing or distortion of an unsupported portion of said axial flange disposed between said drop center and said wheel center; and (f) thereafter finish forming and sizing both said axial flanges and said drop center.

2. The method of claim 1 wherein said forging is subjected to a solution heat treatment prior to mounting said forging on said chuck.

3. The method of claim 1 wherein said forging includes a roughly formed center opening and said method further comprising advancing cutting means to finish machine the periphery of said center opening while said forging is being rotated with said chuck.

4. The method of claim 3 further comprising the step of advancing said cutting means into engagement with the axially inwardly facing surface of said wheel center surrounding said center opening to face said axially inwardly facing surface of said wheel center.

5. The method of claim 1 wherein said method further comprises forcing the outer periphery of a second roller against said rim in a direction generally radially inwardly and then generally axially away from said wheel center to finish form and size said drop center and axial flange farthest from said wheel center, said second roller outer periphery having a radius of curvature less than that of said first roller.

6. The method of claim 5 wherein said roller and said second roller are moved simultaneously axially away from said radial leg, said second roller trailing slightly behind said roller.

7. The method of claim 5 wherein said forging is secured to said chuck by clamping said forging against a tailstock having a contoured surface conforming to the radially outer outside surface of said wheel center and said tire bead retaining flange most adjacent thereto.

8. The method of claim 7 wherein said roller and said second roller are moved radially and axially outwardly from said juncture to finish form said tire bead retaining flange most adjacent said wheel center.

9. A method of forming a vehicle wheel out of a spin formable material, wherein said wheel includes a rim having in cross-section a drop center, generally axial integral flanges extending in opposite directions therefrom , a generally radial tire-bead retaining flange extending from the outside of each of said axial flanges, and a wheel center joining said rim adjacent the axially outer portion of said rim, said method comprising the steps of:

(a) forging a billet of said material into the rough shape of the finished wheel, including said wheel center and a rim portion having in cross-section a relatively long axial leg and a relatively short radial leg, said wheel center joining said rim portion in the vicinity of the juncture of said legs;

(b) roughly forming and contouring said axial leg;

(c) mounting said roughly formed forged billet over a chuck having an external contoured surface conforming to the final inside shape of the wheel from the minimum inside diameter portion of said drop center to the axially outer surface of the tire-bead flange disposed furthest from said wheel center, said contoured surface extending generally axially in the opposite direction from the minimum diameter portion of said drop center to the inside axial surface of said wheel center;

(d) clamping said forging against said chuck using a tailstock having a contoured surface conforming to the radially outer outside surface of said wheel center and said tire-bead retaining flange most adjacent thereto;

(e) rotating said chuck, forging and tailstock about the center axis of said wheel;

(f) thereafter forcing the outer periphery of a roller against said axial leg of said rim in a direction generally radially inwardly and axially toward said wheel center to roughly form the side of said drop center nearest said wheel center, the force and direction being controlled to prevent collapsing or distortion of an unsupported portion of said axial flange disposed between said drop center and said wheel center; and (g) thereafter finish forming and sizing both said axial flanges and said drop center.

10. A method of forming a one-piece vehicle wheel out of a spin formable material, wherein said wheel includes a rim having in cross-section a drop center, generally axial integral flanges extending in opposite directions therefrom, an integral generally radial tire-bead retaining flange extending from the outside of each of said axial flanges, and an integral wheel center joining said rim adjacent the axially outer portion of said rim, said method comprising the steps of:

(a) forging a billet of said material into the rough shape of the finished wheel, including said wheel center and a rim portion having in cross-section a relatively long axial leg and a relatively short radial leg, said wheel center joining said rim portion in the vicinity of the juncture of said legs;

(b) mounting the forging from step (a) over a chuck having an external first contoured surface which is in adjacent radial alignment with said axial leg and has an axial dimension substantially greater than that of said axial leg;

(c) rotating said forging and chuck about the center axis of said wheel;

(d) forcing the outer periphery of a first roller generally radially inwardly into the outside surface of said forging at said juncture to reduce the thickness of said axial leg, said outer periphery of said first roller having a given radius of curvature;

(e) thereafter forcing said first roller in a generally axial direction away from said radial leg to axially extend said axial leg along and against said first contoured surface;

(f) forcing the outer periphery of a second roller generally radially inwardly into the outside surface of said forging at said juncture and then generally axially away from said radial leg, said second roller being moved radially during the generally axial movement to roughly contour said axial leg, said outer periphery of said second roller having a radius of curvature less than that of said first roller;

(g) thereafter mounting said forging over a second chuck and clamping said forging against said second chuck using a tailstock, said chuck having a second external contoured surface conforming to the final shape of the inner surface of the rim portion of said wheel from the minimum inside diameter portion of said drop center to the axially outer surface of the tire-bead flange disposed furthest from said wheel center, said second contoured surface extending generally axially in the opposite direction from the minimum diameter portion of said drop center to the inside axial surface of said wheel center, said tailstock having a contoured surface conforming to the radially outer outside surface of said wheel center and said tire-bead retaining flange most adjacent thereto;

(h) rotating said forging and chuck about the center axis of said wheel;

(i) thereafter forcing the outer periphery of a third roller against said axial leg of said rim in a direction generally radially inwardly and axially toward said wheel center to roughly form the side of said drop center nearest said wheel center, the force and direction being controlled to prevent collapsing or distortion of an unsupported portion of said axial flange disposed between said drop center and said tire-bead retaining flange most adjacent said wheel center, said third roller outer periphery having a given radius of curvature;

(j) thereafter moving said third roller in a generally axial direction away from said wheel center to roughly form the remainder of said drop center and said axial flange disposed farthest from said wheel center; and (k) thereafter forcing the outer periphery of a fourth roller against said rim in a direction generally radially inwardly and then generally axially away from said wheel center to finish form and size said drop center and axial flange farthest from said wheel center, said fourth roller outer periphery having a radius of curvature less than that of said third roller.

11. The method set forth in claim 10 wherein said first and second rollers are moved simultaneously axially away from said radial leg.

12. The method set forth in claim 10 wherein said third and fourth rollers are moved simultaneously axially away from said radial leg.

13. The method set forth in claim 10 wherein said third and fourth rollers are also moved in a direction radially outwardly and axially outwardly from said juncture to finish form said tire-bead retaining flange most adjacent said wheel center.

14. The method set forth in claim 13 wherein said finish forming of said bead retaining flange is performed prior to forming steps set forth in h through j.

15. A method of forming a one-piece vehicle wheel out of a spin formable material, wherein said wheel includes a rim having in cross-section a drop center, generally axial integral flanges extending in opposite directions therefrom, an integral generally radial tire-bead retaining flange extending from the outside of each of said axial flanges, and an integral wheel center joining said rim adjacent the axially outer portion of said rim, said method comprising the steps of:

(a) forging a billet of said material into the rough shape of the finished wheel, including said wheel center and a rim portion having in cross-section a relatively long axial leg and a relatively short radial leg, said wheel center joining said rim portion in the vicinity of the junction of said legs;

(b) roughly forming and contouring said axial leg;

(c) thereafter subjecting said roughly formed forged billet to a solution heat treatment and liquid quenching said roughly formed forged billet to impart a T4 material condition thereto;

(d) thereafter mounting said forging over a chuck and clamping said forging against said chuck using a tailstock, said chuck having an external contoured surface conforming to the final shape of the inner surface of the rim portion of said wheel from the minimum inside diameter portion of said drop center to the axially outer surface of the tire-bead flange disposed furthest from said wheel center, said contoured surface extending generally axially in the opposite direction from the minimum diameter portion of said drop center to the inside axial surface of said wheel center, said tailstock having a contoured surface conforming to the radially outer outside surface of said wheel center and said tire-bead retaining flange most adjacent thereto;

(e) rotating said forging and chuck about the center axis of said wheel;

(f) thereafter forcing the outer periphery of a first roller against said axial leg of said rim in a direction generally radially inwardly and axially toward said wheel center to roughly form the side of said drop center nearest said wheel center, the force and direction being controlled to prevent collapsing or distortion of an unsupported portion of said axial flange disposed between said drop center and said tire-bead retaining flange most adjacent said wheel center, said first roller outer periphery having a given radius of curvature;

(g) thereafter moving said first roller in a generally axial direction away from said wheel center to roughly form the remainder of said drop center and said axial flange disposed farthest from said wheel center; and (h) thereafter forcing the outer periphery of a second roller against said rim in a direction generally radially inwardly and then generally axially away from said wheel center to finish form and size said drop center and axial flange farthest from said wheel center, said second roller outer periphery having a radius of curvature less than that of said first roller.

16. A method of forming a one-piece vehicle wheel out of a spin formable material, wherein said wheel includes a rim having in cross-section a drop center, generally axial integral flanges extending in opposite directions thereform, an integral generally radial tire-bead retaining flange extending from the outside of each of said axial flanges, and an integral wheel center joining said rim adjacent the axially outer portion of said rim, said method comprising the steps of:

(a) forging a billet of said material into the rough shape of the finished wheel, including said wheel center and a rim portion having in cross-section a relatively long axial leg and a relatively short radial leg, said wheel center joining said rim portion in the vicinity of the juncture of said legs;

(b) mounting the forging from step (a) over a chuck having an external first contoured surface which is in adjacent radial alignment with said axial leg and has an axial dimension substantially greater than that of said axial leg;

(c) rotating said forging and chuck about the center axis of said wheel;

(d) forcing the outer periphery of a first roller generally radially inwardly into the outside surface of said forging at said juncture to reduce the thickness of said axial leg, said outer periphery of said first roller having a given radius of curvature;

(e) thereafter forcing said first roller in a generally axial direction away from said radial leg to axially extend said axial leg along and against said first contoured surface;

(f) forcing the outer periphery of a second roller generally radially inwardly into the outside surface of said forging at said juncture and then generally axially away from said radial leg, said second roller being moved radially during said generally axial movement to roughly contour said axial leg, said outer periphery of said second roller having a radius of curvature less than that of said first roller;

(g) thereafter subjecting said forging to a solution heat treatment to impart a T4 material condition thereto;

(h) thereafter mounting said forging over a second chuck and clamping said forging against said second chuck using a tailstock, said chuck having a second external contoured surface conforming to the final shape of the inner surface of the rim portion of said wheel from the minimum inside diameter portion of said drop center to the axially outer surface of the tire-bead flange disposed furthest from said wheel center, said second contoured surface extending generally axially in the opposite direction from the minimum diameter portion of said drop center to the inside axial surface of said wheel center, said tailstock having a contoured surface conforming to the radially outer outside surface of said wheel center and said tire-bead retaining flange most adjacent thereto;

(i) rotating said forging and chuck about the center axis of said wheel;

(j) thereafter forcing the outer periphery of a third roller against said axial leg of said rim in a direction generally radially inwardly and axially toward said wheel center to roughly form the side of said drop center nearest said wheel center, the force and direction being controlled to prevent collapsing or distortion of an unsupported portion of said axial flange disposed between said drop center and said tire-bead retaining flange most adjacent said wheel center, said third roller outer periphery having a given radius of curvature;

(k) thereafter moving said third roller in a generally axial direction away from said wheel center to roughly form the remainder of said drop center and said axial flange disposed farthest from said wheel center;

(l) thereafter forcing the outer periphery of a fourth roller against said rim in a direction generally radially inwardly and then generally axially away from said wheel center to finish form and size said drop center and axial flange farthest from said wheel center, said fourth roller outer periphery having a radius of curvature less than that of said third roller;

(m) thereafter advancing cutting means into engagement with the periphery of said center opening to finish machine said opening and into engagement with an axially inwardly facing surface of said wheel center to finish machine said surface while said forging and said chuck are being rotated.

17. A method of forming a one-piece vehicle wheel out of a spin formable material, wherein said wheel includes a rim having in cross-section a drop center, generally axial integral flanges extending in opposite directions therefrom, an integral generally radial tire-bead retaining flange extending from the outside of each of said axial flanges, and an integral wheel center joining said rim adjacent the axially outer portion of said rim, said method comprising the steps of:

(a) forging a billet of said material into the rough shape of the finished wheel, including said wheel center and a rim portion having in cross-section a relatively long axial leg and a relatively short radial leg, said wheel center joining said rim portion in the vicinity of the juncture of said legs;

(b) mounting said roughly formed forged billet on a chuck and rotating said chuck;

(c) roughly forming said axial leg by means of spinning rollers;

(d) thereafter mounting said forging on a second chuck and clamping said forging against said second chuck using a tailstock, said chuck having an external contoured surface conforming to the final shape of the inner surface of the rim portion of said wheel from the minimum inside diameter portion of said drop center to the axially outer surface of the tire-bead flange disposed furthest from said wheel center, said contoured surface extending generally axially in the opposite direction from the minimum diameter portion of said drop center to the inside axial surface of said wheel center, said tailstock having a contoured surface conforming to the radially outer outside surface of said wheel center and said tire-bead retaining flange most adjacent thereto;

(e) rotating said forging and chuck about the center axis of said wheel;

(f) thereafter forcing the outer periphery of a first roller against said axial leg of said rim in a direction generally radially inwardly and axially toward said wheel center to roughly form the side of said drop center nearest said wheel center, the force and direction being controlled to prevent collapsing or distortion of an unsupported portion of said axial flange disposed between said drop center and said tire-bead retaining flange most adjacent said wheel center, said first roller outer periphery having a given radius of curvature;

(e) thereafter forcing the outer periphery of a second roller against said rim in a direction generally radially inwardly adjacent said juncture and advancing said second roller axially toward the roughly formed side of said drop center to finish form said axial flange most adjacent said wheel center;

(h) thereafter moving said first and second rollers in a generally axial direction away from said wheel center together, said second roller being circumferentially spaced and slightly axially trailing said first roller, said first roller roughly forming the remainder of said drop center and said axial flange disposed furthest from said wheel center and said second roller finish forming and sizing said drop center and said axial flange furthest from said wheel center.

18. The method set forth in claim 15 wherein said second roller is moved generally axially toward said first roller after said first roller roughly forms said side of said drop center nearest said wheel center and prior to general axial movement thereof.

* * * * *

UNITED STATES PATENT AND TRADEMARK OFFICE

CERTIFICATE OF CORRECTION

PATENT NO. : 4,528,734

DATED : July 16, 1985

INVENTOR(S) : Michael J. Beyer

It is certified that error appears in the above-identified patent and that said Letters Patent is hereby corrected as shown below:

Column 3, line 47, after "stock" insert -- 50 --.

Column 5, line 52, "maching" should be -- machining --.

Column 5, line 55, "necesary" should be -- necessary --.

Column 6, line 20, "said" should be -- the --.

Column 6, line 33, "periphey" should be -- periphery --.

Column 7, line 27, "said" should be -- the --.

Column 9, line 12, "said" should be -- the --.

Column 9, line 32, "said" should be -- the --.

Column 11, line 48, "said" should be -- the --.

Column 12, line 30, "(e)" should be -- (g) --.

Signed and Sealed this

*Twenty-fourth* Day of *June 1986*

[SEAL]

*Attest:*

DONALD J. QUIGG

*Attesting Officer*

*Commissioner of Patents and Trademarks*